US009008550B2

(12) United States Patent
Sato

(10) Patent No.: US 9,008,550 B2
(45) Date of Patent: Apr. 14, 2015

(54) PROCESS UNIT AND IMAGE FORMATION APPARATUS HAVING A CLEANING MEMBER IN CONTACT WITH A PROJECTION PORTION

(75) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 195 days.

(21) Appl. No.: 13/597,355

(22) Filed: Aug. 29, 2012

(65) Prior Publication Data

US 2013/0051856 A1 Feb. 28, 2013

(30) Foreign Application Priority Data

Aug. 31, 2011 (JP) ..... 2011-189204

(51) Int. Cl.
*G03G 15/00* (2006.01)
*G03G 21/18* (2006.01)
*G03G 21/00* (2006.01)

(52) U.S. Cl.
CPC ..... *G03G 21/1814* (2013.01); *G03G 21/0011* (2013.01); *G03G 15/751* (2013.01); *G03G 2221/1648* (2013.01); *G03G 2215/0141* (2013.01); *G03G 2221/0015* (2013.01); *G03G 2221/1624* (2013.01)

(58) Field of Classification Search
CPC ..... G03G 15/751; G03G 21/0011; G03G 21/1814; G03G 2221/1648
USPC ..... 399/159, 350, 353, 357
See application file for complete search history.

(56) References Cited

U.S. PATENT DOCUMENTS

2003/0190539 A1* 10/2003 Niimi ..... 399/159
2007/0154239 A1* 7/2007 Fukunaga et al. ..... 399/159
2010/0189482 A1* 7/2010 Azuma et al.

FOREIGN PATENT DOCUMENTS

JP 2005-241720 A 9/2005
JP 2010-169999 A 8/2010
JP 2010-217598 A 9/2010

* cited by examiner

*Primary Examiner* — David Gray
*Assistant Examiner* — Laura Roth
(74) *Attorney, Agent, or Firm* — Marvin A. Motsenbocker; Mots Law, PLLC

(57) ABSTRACT

A process unit includes an image carrier having a surface which includes a main surface and a projection portion, and a cleaning member to remove developer on the surface of the image carrier. The projection portion is provided at least at one end portion of the main surface and includes a rising surface rising up from the main surface. The cleaning member is in contact with the main surface, the rising surface, and a border between the main surface and the rising surface.

14 Claims, 11 Drawing Sheets

FIG.9

| CONDITIONS | CONTINUOUS PRINTING 20K | CONTINUOUS PRINTING 25K | CONTINUOUS PRINTING 30K | CONTINUOUS PRINTING 35K | CONTINUOUS PRINTING 40K | MANUFACTURING COST |
|---|---|---|---|---|---|---|
| COMPARATIVE EXAMPLE 1 | △ | × | × | × | × | 1 |
| COMPARATIVE EXAMPLE 2 | △ | × | × | × | × | 1 |
| FIRST EMBODIMENT | ○ | ○ | ○ | △ | △ | 2 |
| SECOND EMBODIMENT | ○ | ○ | ○ | ○ | △ | 3 |
| THIRD EMBODIMENT | ○ | ○ | ○ | ○ | △ | 4 |

COMPARATIVE EXAMPLE 1 :
(SEAL SPONGES FORMED ON INNER SIDES OF LARGE-DIAMETER PORTIONS)

COMPARATIVE EXAMPLE 2:
(SEAL SPONGES FORMED ON OUTER SIDES OF LARGE-DIAMETER PORTIONS)

PROCESS UNIT AND IMAGE FORMATION APPARATUS HAVING A CLEANING MEMBER IN CONTACT WITH A PROJECTION PORTION

CROSS REFERENCE TO RELATED APPLICATIONS

This application claims priority based on 35 USC 119 from prior Japanese Patent Application No. 2011-189204 filed on Aug. 31, 2011, entitled "PROCESS UNIT AND IMAGE FORMATION APPARATUS", the entire contents of which are incorporated herein by reference.

BACKGROUND OF THE INVENTION

1. Field of the Invention

This disclosure relates to a process unit and an image formation apparatus, and is applicable to, for example, an electrophotographic printer or copying machine (such as a copier).

2. Description of Related Art

In a conventional image formation device (e.g., an electrophotographic printer) having a unit configured to form an image onto a print sheet (called a "process unit" below), a photosensitive drum as an electrostatic latent image carrier is charged by a charge roller which is a charge member. Then, in the conventional image formation apparatus, an electrostatic latent image is formed onto the photosensitive drum by an exposure unit, and a toner image is formed onto the electrostatic latent image on the photosensitive drum by a development device which includes a development roller as a developer carrier, a toner supply roller as a developer supply member configured to supply the development roller with toner which is a developer, and a control blade as a layer formation member configured to form a thin layer of toner on the development roller. Then, the toner image is transferred to a sheet by a transfer roller which is a transfer member. Moreover, in the conventional image formation apparatus, toner remaining on the photosensitive drum after the transfer is collected by a cleaning blade formed of a rubber plate.

Thereafter, in the conventional image formation apparatus, the toner is fixed to the printed sheet by a fixation device, and the printed sheet is then ejected from the printer which is the image formation apparatus.

Patent Literature 1 describes a technique for an image formation apparatus including a process unit in which a cleaning blade is provided for cleaning the photosensitive drum after transfer, as described above (see, for example, Patent Literature 1: Japanese Patent Application Publication No. 2010-217598).

SUMMARY OF THE INVENTION

However, toner removed from the photosensitive drum might fall off to degrade the image quality.

One embodiment of the invention aims to improve the image quality.

An aspect of the invention is a process unit including: an image carrier having a surface which includes a main surface and a projection portion, with the projection portion being provided at least at one end portion of the main surface and having a rising, or elevated, surface rising up or elevated from the main surface; and a cleaning member configured to remove developer on the surface of the image carrier and being in contact with the main surface, the rising surface, and a border between the main surface and the rising surface.

According to this aspect of the invention, the image quality improves.

BRIEF DESCRIPTION OF THE DRAWINGS

FIG. 9 is a diagram showing evaluation results of the image formation apparatuses according to the first through third embodiments.

DETAILED DESCRIPTION OF EMBODIMENTS

Figure 1:
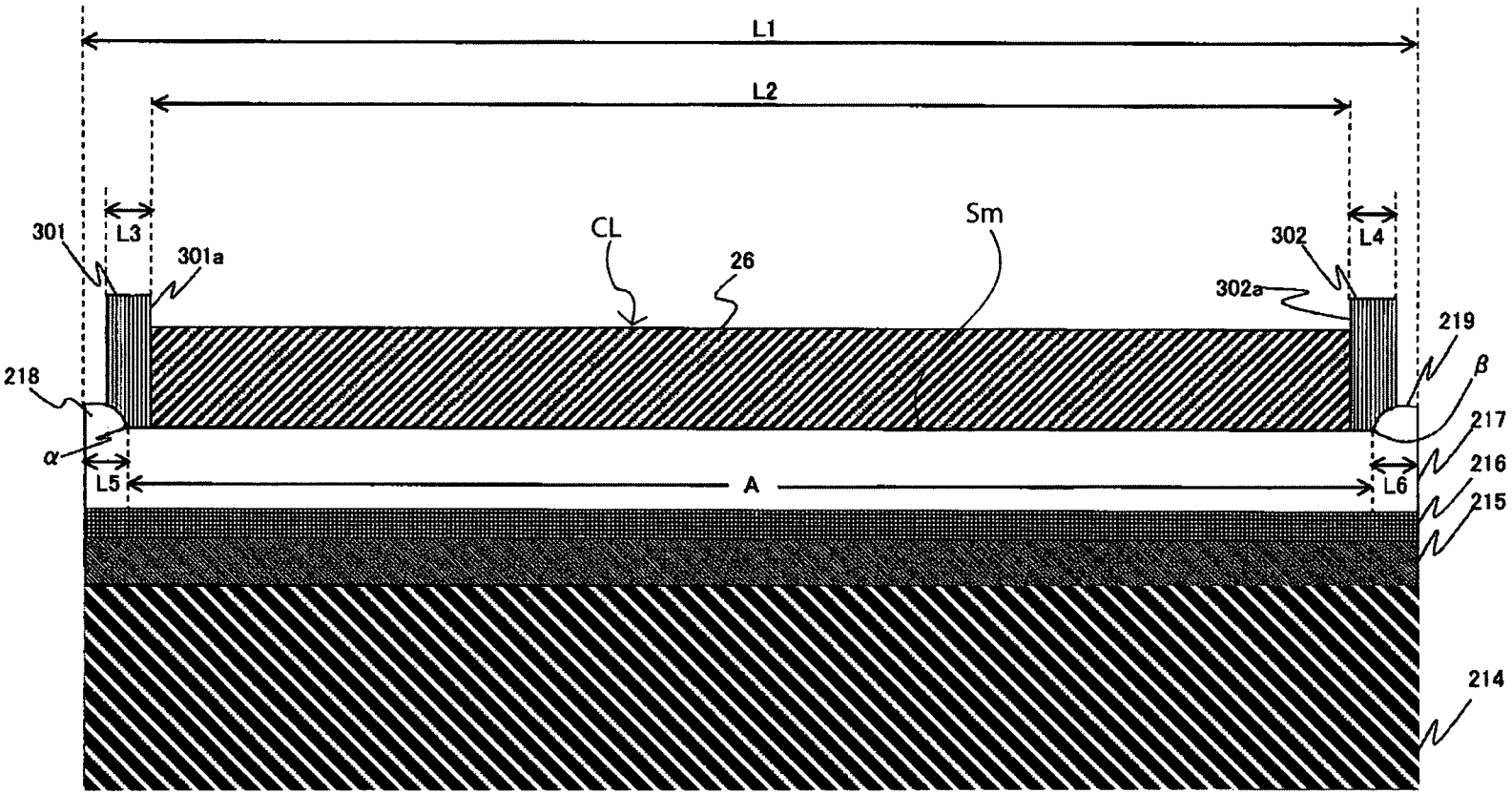
FIG. 1 is a main part enlarged sectional view showing a cleaning member pressed to a photosensitive drum according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) First Embodiment

With reference to the drawings, a first embodiment of a process unit and an image formation apparatus according to the invention are described in detail below. Note that the image formation apparatus of this embodiment is a printer.

(A-1) Configuration of the First Embodiment

Figure 2:
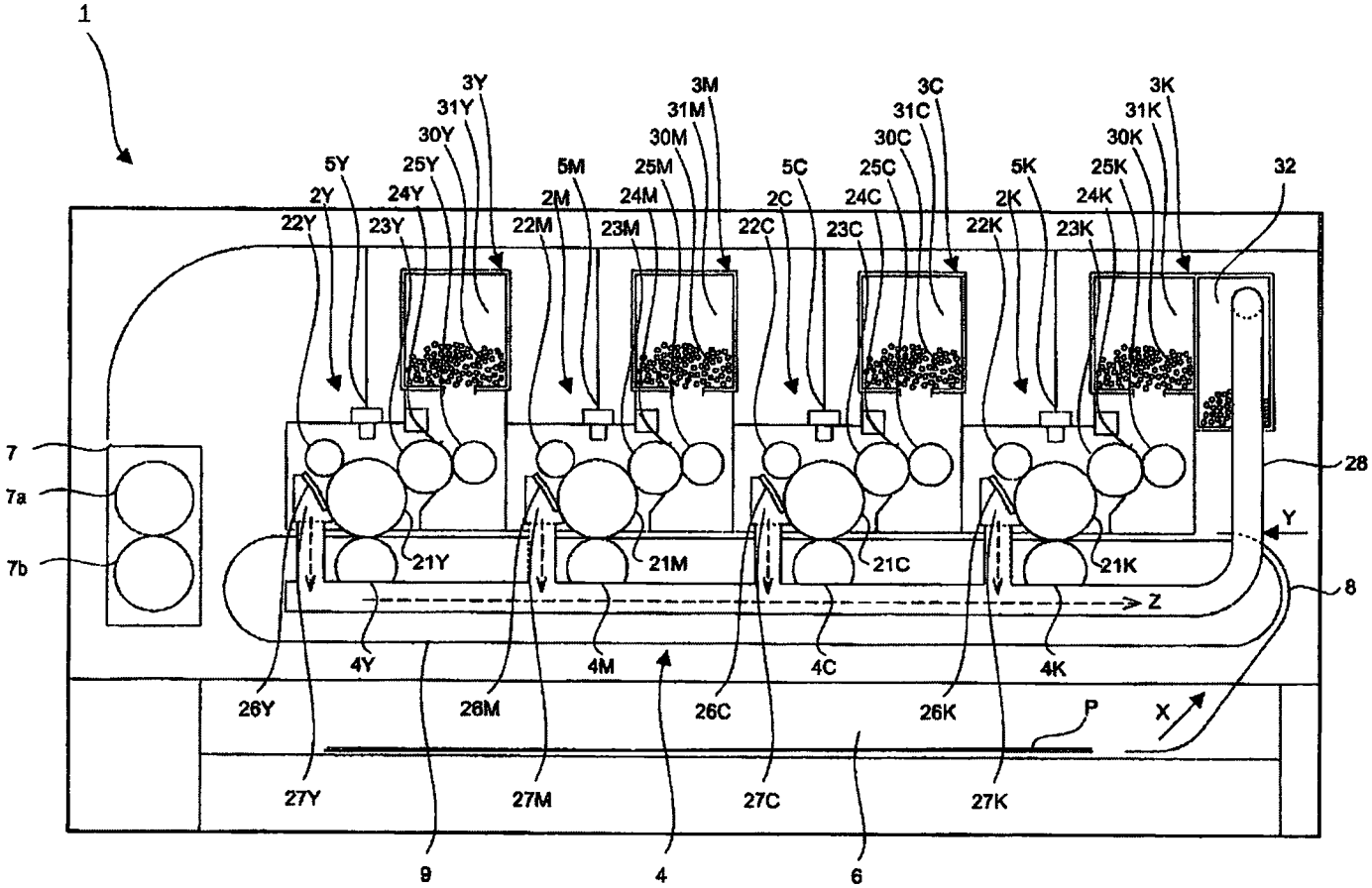
FIG. 2 is a schematic vertical sectional view of a printer (an image formation apparatus) according to the first embodiment.

FIG. 2 is a schematic vertical sectional view of printer 1 of this embodiment.

As shown in FIG. 2, electrophotographic printer 1 as the image formation apparatus includes toner cartridges 3 (3K, 3C, 3M, and 3Y) as developer containers containing toner 30 of black (also referred to as "K" below), cyan (also referred to as "C" below), magenta (also referred to as "M" below), and yellow (also referred to as "Y" below) toner colors (namely, toner 30K, 30C, 30M, and 30Y), respectively. Printer 1 further includes process units 2 (2K, 2C, 2M, and 2Y) corresponding to toner cartridges 3K, 3C, 3M, and 3Y, respectively.

Process units 2 (2K, 2C, 2M, and 2Y) each include a photosensitive drum 21 (21K, 21C, 21M, or 21Y) which is an electrostatic latent image carrier. For each of photosensitive drums 21 (21K, 21C, 21M, and 21Y), printer 1 includes: transfer unit 4 (4K, 4C, 4M, or 4Y) configured to transfer a developed toner image onto a sheet P serving as a transfer medium; and exposure unit 5 (5K, 5C, 5M, or 5Y) configured to irradiate the respective surfaces of corresponding photosensitive drums 21 with light to form an electrostatic latent image thereon. Printer 1 further includes: paper feed cassette 6 configured to house sheet P and to feed sheet P in a direction indicated by an arrow X shown in FIG. 2; fixation unit 7 configured to fix toner images transferred onto sheet P by transfer units 4; and sheet transport path 8 formed into an almost S shape to a lower frame of printer 1.

Process units 2K, 2C, 2M, and 2Y are arranged in this order in a direction indicated by the arrow Y shown in FIG. 2 along sheet transport path 8 from a feed side to an ejection side of sheet P. Process units 2K, 2C, 2M, and 2Y are formed integrally as image formation cartridge 20 which is arranged to be attachable to and detachable from printer 1.

Note that process units 2K, 2C, 2M, and 2Y have the same configuration, except for the color of toner 30K, 30C, 30M, and 30Y. Accordingly, only process unit 2K configured to develop toner 30K of black (K) is described below, and other process units 2C, 2M, and 2Y are not described.

Process unit 2K includes: photosensitive drum 21K; charge roller 22K which is a charge member configured to evenly charge the surface of photosensitive drum 21K; development roller 23K which is a development member configured to develop toner 30K onto photosensitive drum 21K; development blade 24K which is a toner layer thickness restriction member configured to restrict the layer thickness of toner 30K supplied to development roller 23K; supply roller 25K which is a supply member configured to supply toner 30K to development roller 23K; cleaning member CL which is a toner removal member configured to remove remaining toner 30K not having been transferred onto sheet P but remaining on photosensitive drum 21K; and first transport unit 27K which is a transport unit configured to transport removed toner 30K which is removed by cleaning member CL as waste toner 30K.

Photosensitive drum 21K is formed of, for example, a conductive support and a photosensitive layer, and is an organic photoconductor in which a charge generation layer and a charge transport layer are stacked in this order as a blocking layer and a photosensitive layer onto a pipe which is a photosensitive base made of metal such as aluminum.

Charge roller 22K may be formed of, for example, a metallic shaft and a semiconductor rubber layer made of epichlorohydrin rubber or the like. Charge roller 22K is in contact with photosensitive drum 21K with a predetermined amount of pressure contact, and rotates following the rotation of photosensitive drum 21K.

Development roller 23K may be formed of, for example, a metallic shaft and a semiconductor urethane rubber layer. Development roller 23K is in contact with photosensitive drum 21K with a predetermined amount of pressure contact, and rotates in a counter direction of the rotation of photosensitive drum 21K with a predetermined peripheral speed ratio.

Development blade 24K is, for example, 0.08 mm thick, has substantially the same longitudinal length as development roller 23K, and is a metallic thin-plate member configured to restrict the layer thickness of toner 30K. One of the edges of the development blade 24K extending in the longitudinal direction is fixed to a frame (not shown) of process unit 2K, and the other edge is in contact with development roller 23K at a surface slightly inward of a tip end portion of the edge.

Supply roller 25K may be formed of, for example, a metallic shaft and a semiconductor foamed silicone sponge layer. Supply roller 25K is in contact with development roller 23K with a predetermined amount of pressure contact, and rotates in a counter direction of the rotation of development roller 23K with a predetermined peripheral speed ratio.

Cleaning member CL includes support 261, cleaning blade 26K which is a cleaning member body supported on support 261, and seal sponges 301 and 302 which are seal members attached to both ends of cleaning blade 26K, respectively. Cleaning blade 26K is arranged at such a position that one edge thereof is to be in contact with photosensitive drum 21K with a predetermined amount of pressure contact. Cleaning blade 26K may be formed using, for example, a urethane rubber member.

First transport unit 27K is configured to transport waste toner 30K (e.g. remaining toner 30K and any other adhered matter that were attached to photosensitive drum 21*k* and then removed by cleaning blade 26K) toward a near side in a rotational axis direction of photosensitive drum 21K.

Second transport unit 28 is configured to collectively transport waste toners 30K, 30C, 30M, and 30Y transported by first transport units 27K, 27C, 27M, and 27Y of process units 2K, 2C, 2M, and 2Y, respectively, in a direction indicated by the dashed arrow Z.

Toner cartridge 3K, 3C, 3M, and 3Y include toner supply containers 31K, 31C, 31M, and 31Y which have a hollow structure and which are configured to contain unused black (K) toner 30K, cyan (C) toner 30C, magenta (M) toner 30M, and yellow (Y) toner 30Y, respectively. Among these toner cartridges 3K, 3C, 3M, and 3Y, only toner cartridge 3K for black (K) located at the most upstream of sheet transport path 8 includes waste toner container 32 which is provided along with toner supply container 31K. Waste toner container 32 has a space adjacent to and independent of toner supply container 31K, and is configured to contain waste toners 30K, 30C, 30M, and 30Y transported by second transport unit 28.

Note that image formation cartridge 20 and toner cartridges 3K, 3C, 3M, and 3Y are all configured as units attachable to and detachable from printer 1 (i.e., as replaceable units). Accordingly, these cartridges respectively containing toners 30K, 30C, 30M, or 30Y can be replaced when the toner in any respective cartridge has all been consumed or when a component in the cartridge has deteriorated, for example.

Transfer unit 4 includes: transfer belt 9 configured to electrostatically absorb, i.e. receive, sheet P and transfer sheet P; a drive roller (not shown) configured to drive transfer belt 9 by being rotated by a drive unit (not shown); a tension roller (not shown) which forms a pair with the drive roller so that transfer belt 9 lays across them in a tensioned state; and transfer rollers 4K, 4C, 4M, and 4Y arranged to face and be in pressure contact with corresponding photosensitive drums 21K, 21C, 21M, and 21Y and configured to apply voltages to transfer toner images onto sheet P.

Exposure units 5K, 5C, 5M, and 5Y are, for example, LED heads each including a light emitting device, such as a light emitting diode (LED), and a lens array. In descriptions given below, a toner image is formed onto photosensitive drum 21K using an LED head in process unit 2K. However, other methods may be used instead.

Paper feed cassette 6 is configured to house stacked sheets P inside, and is detachably attached in a lower part of printer 1. A sheet feeder (not shown) including components such as a hopping roller configured to pick up and feed sheet P, one at a time, is arranged in an upper part of paper feed cassette 6.

Fixation unit 7 is arranged at a downstream side of sheet transport path 8 and includes heat roller 7*a*, pressure roller 7*b*, a thermistor (not shown), and a heater (not shown). Heat roller 7*a* is formed by coating a hollow cylindrical core bar made of aluminum, for example, with a heat-resistant elastic layer made of silicone rubber, and then covering this with a PFA (a copolymer of tetrafluoroethylene and perfluoroalkylvinylether) tube. The heater, such as a halogen lamp, is provided inside the core bar. Pressure roller 7*b* is formed by coating a core bar made of aluminum, for example, with a heat-resistant elastic layer made of silicone rubber and then by covering this with a PFA tube. Pressure roller 7*b* is arranged so as to form a pressure contact portion between pressure roller 7*b* and heat roller 7*a*. The thermistor is a device for detecting the surface temperature of heat roller 7*a*, and is arranged near heat roller 7*a* with no contact therebetween.

Figure 3:
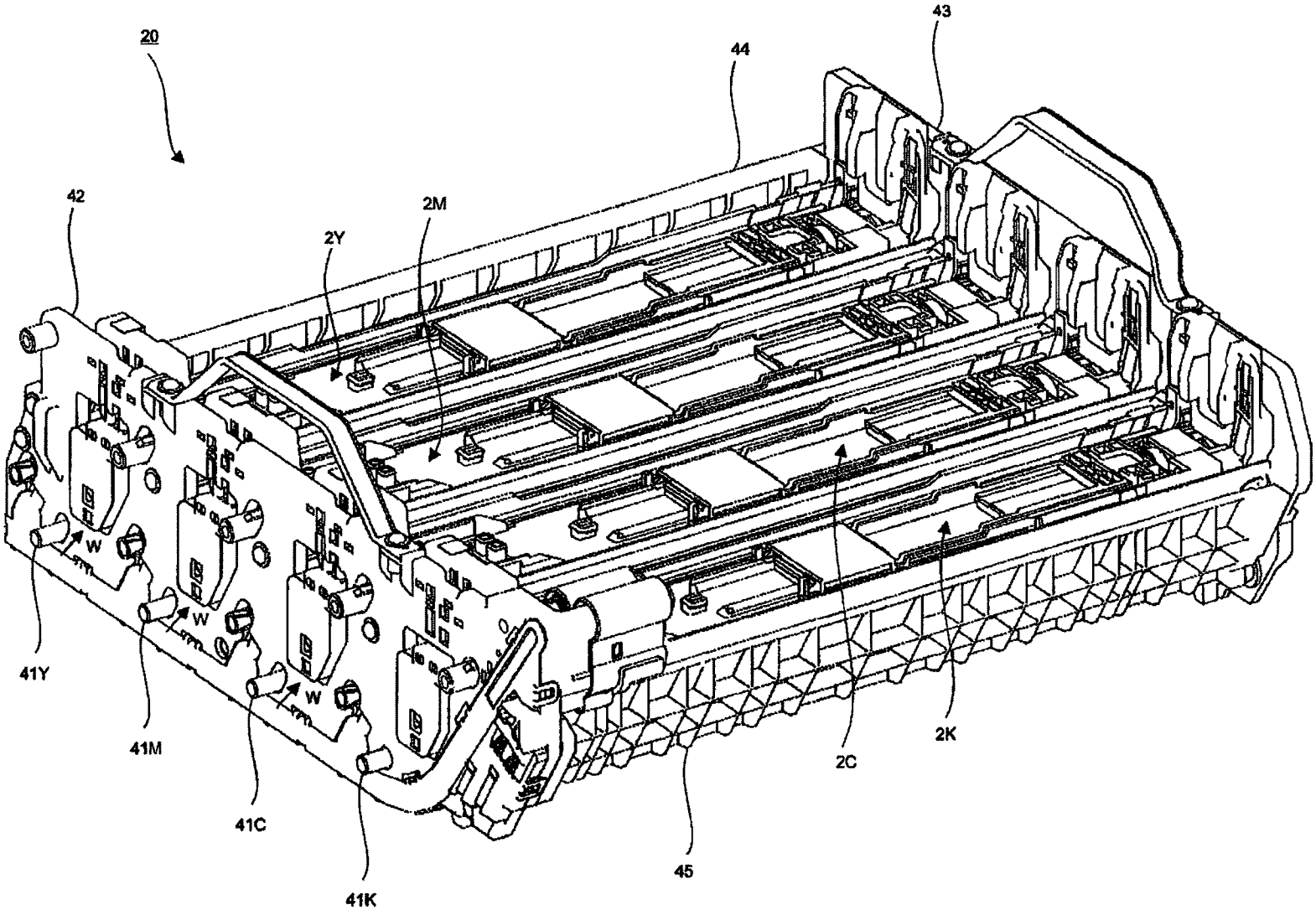
FIG. 3 is a perspective view of an image formation cartridge according to the first embodiment.

FIG. 3 is a perspective view of image formation cartridge 20.

In image formation cartridge 20, process units 2K, 2C, 2M, and 2Y are arranged at equally-spaced intervals and are integrally formed by being fixed to rigid first side frame body 42 and rigid second side frame body 43 at both sides of each process unit, as well as to front frame 44 and to back frame 45.

Photosensitive drum rotation supports (photosensitive drum shafts) 41K, 41C, 41M, and 41Y are, for example, formed of metal having a certain rigidity and a sufficient conductivity. Image formation cartridge 20 is attached and detached by placing photosensitive drum shafts 41K, 41C, 41M, and 41Y along guides (not shown) inside printer 1. Photosensitive drum shafts 41C for cyan (C), 41M for magenta (M), and 41Y for yellow (Y) can be moved in directions indicated by arrows W by a process unit lift-up mechanism (not shown) which allows process units 2C, 2M, and 2Y to be spaced from transfer belt 9.

As described above, process units 2K, 2C, 2M, and 2Y are integrally formed in image formation cartridge 20. In this embodiment, process units 2K, 2C, 2M, and 2Y are described as being integrally formed on image formation cartridge 20 as shown in FIG. 3. However, process units 2K, 2C, 2M, and 2Y may be designed to be attachable and detachable independently. Moreover, as to the process units of the invention, how to mount them to the printer and the like are not limited, and known various configurations can be applied to the outer shape and the like of a case (frame) housing the process units.

Figure 4B:
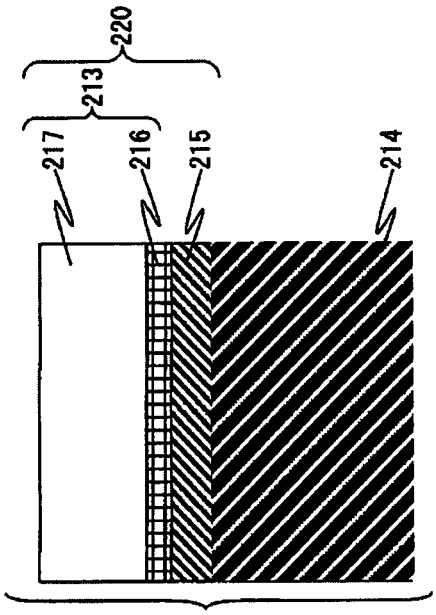
FIG. 4B is an enlarged sectional view of a part of the photosensitive drum according to the first embodiment.
Figure 4A:
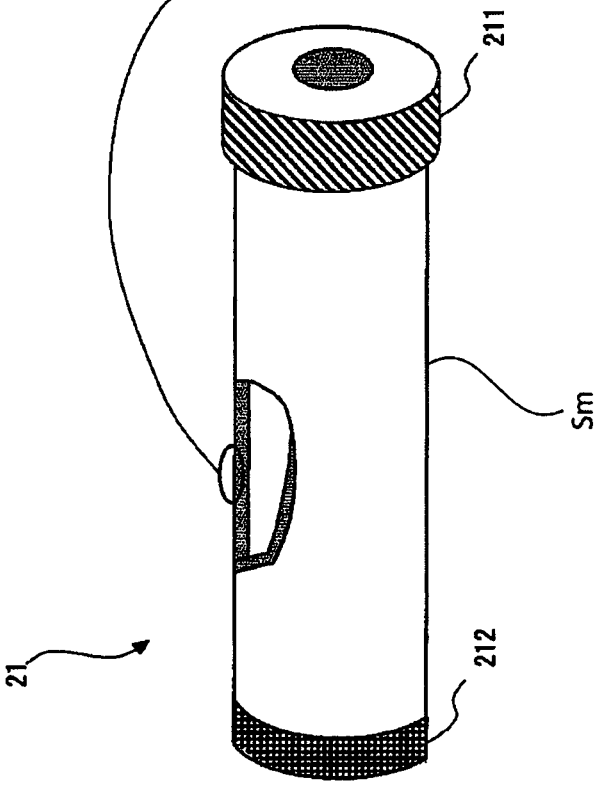
FIG. 4A is a schematic perspective view of the photosensitive drum.

FIGS. 4A and 4B illustrate photosensitive drum 21.

FIG. 4A shows a schematic perspective view of photosensitive drum 21. FIG. 4B shows a partial section of a cylinder of photosensitive drum 21 shown in FIG. 4A.

Photosensitive drum 21 includes drum gear 211, drum flange 212, and conductive support 214 which is a conductive support machined into a cylinder shape. Blocking layer 215, charge generation layer 216, and charge transport layer 217 are stacked on conductive support 214 in this order, with the blocking layer 215 being the lowest layer. Photosensitive layer 213 is formed of charge generation layer 216 and charge transport layer 217. In other words, in photosensitive drum 21, surface layer 220 is formed on a surface of conductive support 214. Surface layer 220 includes blocking layer 215 and photosensitive layer 213 (i.e., charge generation layer 216 and charge transport layer 217).

Drum gear 211 is fixed to the inside of conductive support 214 through press-fitting, with an adhesive, or the like. A drive gear (not shown) engages with drum gear 211, and is rotatably fitted to a stationary shaft fixed to a frame (not shown). Accordingly, photosensitive drum 21 is rotated by driving the drive gear to rotate drum gear 211. Drum gear 211 and the drive gear are formed of helical gears in which the twist angles of their teeth are set in opposite directions from each other.

Drum flange 212 is fixed to the inside of conductive support 214, which is a negative terminal of photosensitive drum 21 through press-fitting and with an adhesive. Drum flange 212 may be made to be conductive by combining conductive powder such as metallic powder, carbon black, or graphite in a synthesis resin such as polyamide, polycarbonate, an ABS resin, or polyacetal. Drum flange 212 and drum gear 211 are rotatably attached onto photosensitive drum shaft 41.

Conductive support 214 is, for example, an insulating support made of a polyester film, paper, or glass onto which a conductive layer is provided made of aluminum, copper, palladium, tin oxide, indium oxide, conductive polymer, or the like. Conductive support 214 can also be a metal support made of a metallic material such as aluminum, stainless steel, copper, nickel, zinc, indium, gold, or silver. Among these materials, a metallic endless pipe cut to a proper length is preferable, and aluminum is used most preferably.

Blocking layer 215 is, for example, an inorganic layer of an aluminum anodic oxide film (alumite), aluminum oxide, or aluminum hydroxide, or an organic layer of polyvinyl alcohol, casein, polyvinylpyrrolidone, polyacrylic acid, celluloses, gelatin, starch, polyurethane, polyimide, polyamide, or the like.

Usable charge generation materials for charge generation layer 216 are, for example, selenium and its alloy, arsenic compound selenide, cadmium sulfide, zinc oxide, and other inorganic photosensitive materials, as well as an organic pigment or dye such as phthalocyanine, azo dye, quinacridone, polycyclic quinone, pyrylium salt, thiapyrylium salt, indigo, thioindigo, anthanthrone, pyranthrone, or cyanine. Preferable materials among them are phthalocyanines to which metal such as metal-free phthalocyanine, copper indium chloride, gallium chloride, oxytitanium, zinc, or vanadium is coordinated, or an oxide or chloride of such metal is coordinated, or an azo pigment such as monoazos, bisazos, trisazos, or polyazos. Charge generation layer 216 may be a dispersion layer in which fine particles of these materials are bound by any of various binder resins such as, for example, one or a mixture of a polyester resin, polyvinyl acetate, polyacrylic acid ester, polymethacrylic acid ester, polyester, polycarbonate, polyvinyl acetoacetal, polyvinyl propional, polyvinyl butyral, a phenoxy resin, an epoxy resin, a urethane resin, and a cellulosic ester. In this case, the ratio of the fine particles to the binder resin is in a range of 30 to 500 parts by mass to 100 parts binder resin. The suitable film thickness is typically 0.1 to 2 μm. When necessary, charge generation layer 216 may include various additives to improve coatability, such as a leveling agent, an antioxidizing agent, and a sensitizer. Further, charge generation layer 216 may be a vapor-deposited film of the charge generation materials described above.

Usable charge transport materials for charge transport layer 217 are, for example, electron-releasing materials such as a heterocyclic compound or an aniline derivative, a hydrazine compound, an aromatic amine derivative, a stilbene derivative, or a polymer having a group of any of these compounds in its main chain or side chain. The heterocyclic compound includes carbazole, indole, imidazole, oxazole, pyrazole, oxadiazole, pyrazoline, or thiadiazole.

The binder resin typically used for charge transport layer 217 is, for example, one or a mixture of polycarbonate, a vinyl polymer such as polymethylmethacrylate, polystyrene, polyvinyl chloride, a polyester resin, a polyester carbonate resin, a polysulfone resin, a polyimide resin, a phenoxy resin, an epoxy resin, a silicone resin, as well as copolymers thereof, and partially cross-linked cured products thereof.

When necessary, charge transport layer 217 may include various additives such as an antioxidizing agent and a sensitizer. The film thickness of charge transport layer 217 is typically 10 to 30 micrometer (μm). When photosensitive layer 213 is of a dispersion type, any of the charge generation materials described above is dispersed in a charge transport medium with the above-described ratio with a combination of the binder resin and the charge transport material described above. In this case, the particle diameter of the charge generation material needs to be sufficiently small, namely, 1 μm or smaller. If too little amount of the charge generation material is dispersed into the photosensitive layer, sufficient sensitivity cannot be obtained, and too much amount of the charge generation material would bring about adverse effects such as a degradation in the chargeability and a degradation in sensitivity. The amount of the charge generation material should be in a range of 0.5 to 50 percent by weight.

Figure 5:
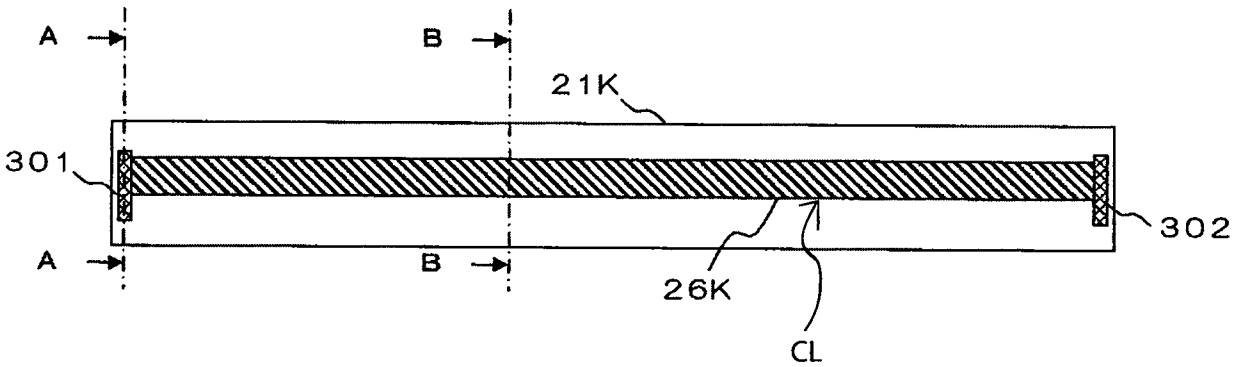
FIG. 5 is a schematic side view showing the cleaning member pressed to the photosensitive drum according to the first embodiment.

FIG. 5 is a schematic side view showing cleaning member CL pressed to photosensitive drum 21K.

FIG. 5 is a view seen from a side near cleaning member CL in contact with photosensitive drum 21K. Note that FIG. 5 does not show components other than photosensitive drum 21K and cleaning member CL to simplify the description.

Figure 6:
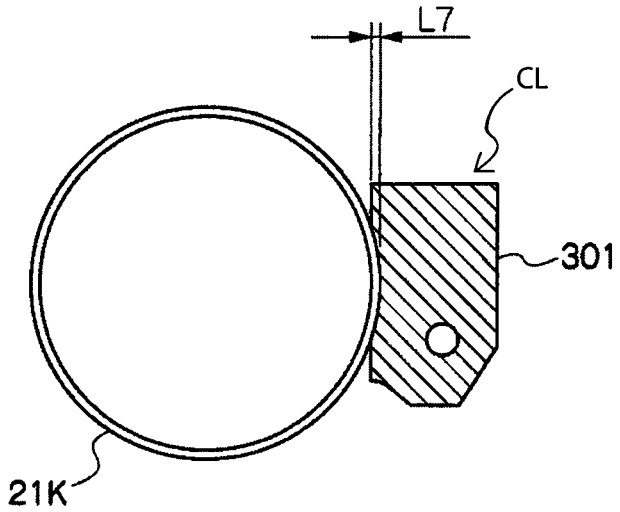
FIG. 6 is a sectional view taken along a line A-A of FIG. 5.
Figure 7:
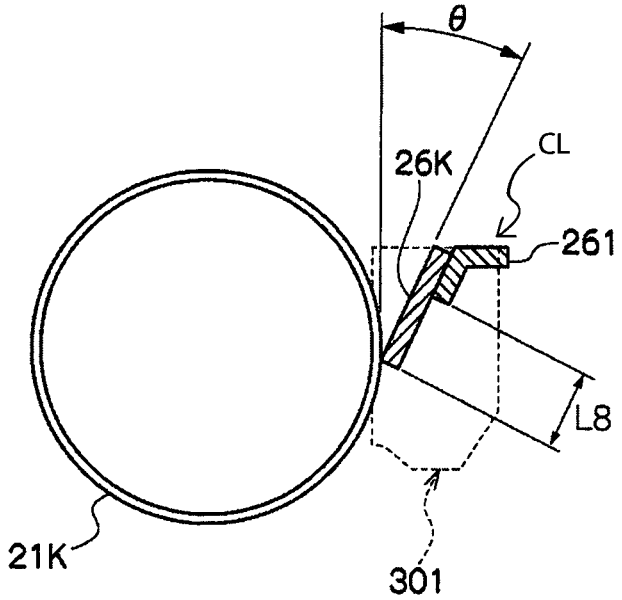
FIG. 7 is a sectional view taken along a line B-B of FIG. 5.

FIG. 6 is a sectional view taken along a line A-A in FIG. 5 (a cross section of a part including one of the seal sponges, seal sponge 301, of cleaning blade 26K). FIG. 7 is a sectional view taken along a line B-B in FIG. 5 (a cross section of a part including a body part of cleaning blade 26K).

As shown in FIGS. 5 and 7, cleaning blade 26K has a substantially rectangular plate shape, and is supported by support plate 261. A partial area of a plate surface of cleaning blade 26K is a contact portion that is in contact with a plate surface of support plate 261, and cleaning blade 26K is fixed to support plate 261 by this contact portion.

The plate thickness of cleaning blade 26K is not limited, but is preferably about 0.5 mm to 5 mm for example. In this embodiment, the plate thickness is set to 1.65 mm. Moreover, the length of the free end portion of cleaning blade 26K (the short-side length of an area not in contact with support plate 261) is not limited. In FIG. 7, the length of this free end portion is expressed as L8. Although not limited, L8 is preferably about 2 mm to 10 mm for example, and is set to 7.2 mm in this embodiment.

Seal sponges 301 and 302 are attached to both longitudinal ends of cleaning blade 26K as seal members to prevent a leak of toner 30.

As shown in FIGS. 5 to 7, seal sponges 301 and 302 each have a substantially rectangular plate shape. An edge portion of cleaning blade 26K, along with seal sponges 301 and 302, is in contact with photosensitive drum 21 with a predetermined amount of pressure contact. Further, as shown in FIG. 7, cleaning blade 26K is in contact with photosensitive drum 21K at a predetermined contact angle θ. As shown in FIG. 7, the contact angle 8 is an angle formed by a tangent line of a sectional circle of photosensitive drum 21K and the short side of cleaning blade 26K. The contact angle θ is not limited, but is preferably 5° to 45°. In this embodiment, the contact angle θ is set to 27.89°.

In addition, as shown in FIGS. 6 and 7, surfaces (edge surfaces) of seal sponges 301 and 302 that are in contact with photosensitive drum 21K are each formed into such a shape that the surface projects from a position of a tip edge of cleaning blade 26K (i.e., of a portion in contact with photosensitive drum 21K) by a width of L7. The width of L7 is not limited, but is set to 0.67 mm in this embodiment.

To be more specific, the shape and position of each of seal sponges 301 and 302 are adjusted so that, when cleaning blade 26K is brought into contact with photosensitive drum 21K with the predetermined amount of pressure contact at the predetermined contact angle θ, the contact surfaces (edge surfaces) of seal sponges 301 and 302 may be pressed to photosensitive drum 21K, as well.

Note that seal sponge 302 is not illustrated because it can be explained using FIG. 6 similarly with seal sponge 301. Seal sponge 301 and seal sponge 302 may have the exact same shape, or may be partially different from each other.

The shapes of the plate surfaces of seal sponges 301 and 302 may be appropriately changed as long as they can fulfill the function of toner 30 leak prevention. Here, as an example, the longitudinal length (long-side length) of each plate surface is set to 18.58 mm, and the lateral length (short-side length) of the plate surface is set to 11 mm. Moreover, the plate thickness of each of seal sponges 301 and 302 may be appropriately changed as long as they fulfill the function of toner 30 leak prevention, but is preferably set to 2 mm to 10 mm for example. Here, the thickness is set to 4 mm.

For example, a general urethane foam sponge can be used for seal sponges 301 and 302. The modulus of repulsive elasticity of the material used for seal sponges 301 and 302 is not limited, but is preferably about 5% to 50%, and set to 30% in this embodiment. The hardness (25% hardness) of the material used for seal sponges 301 and 302 is not limited, but is preferably about 5 to 40 kgf, and is 10 kgf in this embodiment.

Next, an example of a method of forming photosensitive drum 21K is described referring to FIG. 4 used above.

As to how to form each layer of photosensitive drum 21K, known methods can be used, such as sequentially applying an application liquid obtained by dissolving or dispersing a material to be contained in the layer into a solvent. An example of how to form the layers constituting photosensitive drum 21K is described below.

Conductive support 214 is formed by machining an aluminum alloy billet of the JIS-A3000 series, which is an alloy obtained by mixing silicon or the like into aluminum, into an extruded pipe by a porthole method. The pipe thus extruded is then cut into a cylinder of a predetermined thickness and outer diameter. In the first embodiment, the extruded cylindrical pipe has an outer diameter of 30 mm, a length of 253.45 mm, and a thickness of 0.75 mm. Although not limited, the thickness of conductive support 214 is preferably set to about 0.5 mm to 1.5 mm, for example.

Conductive support 214 thus formed is subjected to surface finishing in a washing tank to adequately remove the oil on the surface and various dusts in the air. Thereafter, blocking layer 215 is formed on the surface. In the invention, blocking layer 215 is formed with an anodic oxide film (an alumite layer) by performing an anodic oxidation treatment and then a sealing treatment using nickel acetate as a main component.

Charge generation layer 216 is formed on blocking layer 215 using a dip and coat method in which conductive support 214 having blocking layer 215 formed thereon is dipped into a liquid tank filled with an application liquid prepared for charge generation layer 216, and is thereby coated. By this dip and coat, charge generation layer 216 of about a 0.3 μm thickness is formed in the invention. The charge-generation-layer application liquid used in the invention is a charge-generation-layer dispersion liquid obtained as follows. First, 100 parts (parts by mass) of a binder solution with a 5% solid content concentration is obtained by dissolving 5 parts polyvinyl butyral in 95 parts 1,2-dimethoxyethane, and this binder solution is mixed into 160 parts pigment-dispersed solution obtained by adding 10 parts oxotitanium phthalocyanine to 150 parts dimethoxyethane. Then, this solution is subjected to grinding and dispersion treatment by a sand grinding mill, so that the final liquid may be adjusted and prepared to have a 4% solid content concentration and a ratio of 1,2-dimethoxyethane:4-methoxy-4methylpentanoate2=9:1.

After the application of charge generation layer 216, conductive support 214, in which charge generation layer 216 is thus applied onto blocking layer 215, is dried to remove extra solvent in charge generation layer 216 and to fix charge generation layer 216 onto blocking layer 215.

After the drying, charge transport layer 217 is formed on charge generation layer 216. An example of a method of forming charge transport layer 217 is a dip and coat method in which conductive support 214, having charge generation layer 216 formed thereon, is dipped into a liquid tank filled with an application liquid prepared for charge transport layer 217, and is thereby coated. The charge-transport-layer application liquid is a liquid obtained by dissolving mainly a binder resin and a charge transport material into a solvent.

Finally, charge transport layer 217, applied onto charge generation layer 216 by the dip and coat method, is dried to remove extra solvent in charge transport layer 217 and to fix it onto charge generation layer 216.

Next, the shape of photosensitive drum 21K is described in detail.

FIG. 1 is a main part enlarged sectional view showing cleaning blade 26K (including seal sponges 301 and 302) in pressure contact with photosensitive drum 21K.

Note that, in FIG. 1, the reduced scale of only the thickness of each layer of photosensitive drum 21K (a cylindrical drum body portion) is shown smaller to simplify the description. Note also that, hereinbelow, an "inner side" refers to a direction toward a side where, as seen from each of seal sponges 301 and 302, the other one of seal sponges is located, and an "outer side" refers to a direction toward the opposite side (where an end of photosensitive drum 21K is located).

In FIG. 1, L1 indicates the width (longitudinal width) of a cylindrical part of photosensitive drum 21K. In addition, in FIG. 1, L2 indicates the distance between inner face 301*a* of seal sponge 301 and inner face 302*a* of seal sponge 302 (i.e., the longitudinal width of the main body of cleaning blade 26K). Further, L3 indicates the plate thickness of seal sponge 301, and L4 indicates the plate thickness of seal sponge 302. L3 and L4 may have different dimensions from each other, but are the same herein.

As shown in FIG. 1, photosensitive drum 21K has steps in its surface at portions (areas) in contact with seal sponges 301 and 302. As shown in FIG. 1, both end portions of photosensitive drum 21K are larger in its outer diameter than the other portion thereof, and the end portions have predetermined axial lengths from their corresponding outermost ends. Hereinbelow, these portions (areas) having a larger diameter are referred to as protrusion portions or large-diameter portions 218 and 219, whereas a portion (area) not having any larger diameter is referred to as amain surface Sm.

As shown in FIG. 1, in the first embodiment, the large-diameter portions 218 and 219 are gradually increased in their outer diameters to the outer side from their innermost ends which have the smallest outer diameters, so as to form rising surfaces (elevated or stepped surfaces). In FIG. 1, the rising surface located at the inner side of large-diameter portion 218 is indicated by α, while the rising surface located at the inner side of large-diameter portion 219 is indicated by β. In other words, large-diameter portions 218 and 219 are provided with rising surfaces α and β at their inner sides, respectively, and are gradually increased in outer diameter from their respective boarder points between main surface Sm and large-diameter portions 218 and 219. In FIG. 1, the cross section of rising surface α (or β) described above is arc-shaped, as an example. However, the detailed cross-sectional shape of each rising surface α or β (i.e., how the outer diameter is increased) is not limited to such a shape as long as it is increased in outer diameter toward the outer side.

In FIG. 1, L5 indicates the width of large-diameter portion 218, and L6 indicates the width of large-diameter portion 219. L5 and L6 may have different dimensions from each other, but are the same herein. Although not limited, the dimension of each of L5 and L6 is preferably 1 mm to 5 mm, for example, and is 2.5 mm in this embodiment.

Seal sponge 301 is in contact with an area including rising surface α located at the inner side of the large-diameter portion 218. Similarly, seal sponge 302 is in contact with an area including rising surface β located at the inner side of the large-diameter portion 219.

The difference between the maximum outer diameter of each of large-diameter portions 218 and 219 and the outer diameter of main surface Sm (i.e., a portion other than large-diameter portions 218 and 219) (namely, the height of each step) is preferably 1 to 3 times, but may be more than 10 times, the film thickness of charge transport layer 217. In the first embodiment, the height of each step is 50 μm, which is about 2.5 times the film thickness of charge transport layer 217. Note that problems may occur when the step is too high, such as wear of seal sponge 301 or 302 in contact. On the other hand, problems may occur when the step is too short, such as a decrease in the effect of toner leak prevention. However, such problems can be avoided by adjusting the step height (rising surface height) appropriately within the range described above.

In photosensitive drum 21K, the main surface Sm is the area to fulfill the function as a regular photosensitive layer area (an electrostatic latent image carrier area) (i.e., an area by which a toner image is transferred onto sheet P). The main surface Sm is, in other words, an area inward of large-diameter portions 218 and 219 (between surface α and surface β) (this area is indicated by A in FIG. 1).

As described above, seal sponges 301 and 302 have to be in contact with the areas including rising surfaces α and β, respectively. In order to bring seal sponges 301 and 302 into contact with large-diameter portions 218 and 219, the dimensions may be easily adjusted in the following way, although it is not limited thereto. For example, the width of photosensitive layer region A is made longer than the length (L2) of the contact area of cleaning blade 26K, but shorter than a total length of the contact area of cleaning blade 26K and the contact areas of seal sponges 301 and 302 (i.e., L2+L3+L4). Further, end portions of photosensitive layer region A are located inside the contact areas of seal sponges 301 and 302.

An example of how large-diameter portions 218 and 219 may be formed on the surface of photosensitive drum 21K is described below, although it is not limited thereto.

As described earlier, charge transport layer 217 may be formed on charge generation layer 216 in the process for forming photosensitive drum 21K using, for example, the dip and coat method in which conductive support 214 having charge generation layer 216 formed thereon is dipped into a liquid tank filled with an application liquid prepared for charge transport layer 217, and is thereby coated. During this, the charge-transport-layer liquid may be accumulated or pooled on both end portions of photosensitive drum 21K (i.e., conductive support 214). In the first embodiment, large-diameter portions 218 and 219 are formed utilizing this charge-transport-layer application liquid (charge transport layer 217) accumulated on both end portions of photosensitive drum 21K (conductive support 214). To form large-diameter portions 218 and 219 by using the accumulated liquid for area-by-area outer diameter adjustment of photosensitive drum 21K, the speed of dipping conductive support 214 into the charge-transport-layer application liquid may be adjusted only for the areas where large-diameter portions 218 and 219 are to be formed. The number of coatings of the charge-transport-layer application liquid may be adjusted only for the areas where large-diameter portions are to be formed, or a charge-transport-layer application liquid having a different viscosity may be additionally applied to the areas where large-diameter portions are to be formed, for example.

(A-2) Operations of the First Embodiment

Next, operations of printer 1 of the first embodiment having the above configuration are described.

(A-2-1) Overall Operations of the Printer

Operations of printer 1 are described first, using FIG. 2.

In printer 1, process units 2K, 2C, 2M, and 2Y are driven in response to print data receipt, and toner 30K, 30C, 30M, and 30Y are provided from toner cartridges 3K, 3C, 3M, and 3Y. In response to the print data receipt, sheet P in paper feed cassette 6 is fed in the X direction and transported in the Y direction along sheet transport path 8. While sheet P thus transported passes under process units 2K, 2C, 2M, and 2Y sequentially, toner images are formed on photosensitive drums 21K, 21C, 21M, and 21Y which are exposed to light by exposure units 5K, 5C, 5M, and 5Y, and are transferred onto sheet P by transfer units 4K, 4C, 4M, and 4Y, respectively. The toner images are then fixed on sheet P by fixation unit 7, and the sheet P is ejected to the outside of printer 1.

Since process units 2K, 2C, 2M, and 2Y each perform the same basic operations, in the descriptions given below for process units 2K, 2C, 2M, and 2Y, only process unit 2K configured to develop toner 30K of black (K) is described, and other process units 2C, 2M, and 2Y are not described.

Photosensitive drum 21K is charged evenly at its surface by charge roller 22K, and an electrostatic latent image is formed on photosensitive drum 21K by the light applied by exposure unit 5K.

Charge roller 22K is connected to a charge-roller power supply (not shown) configured to apply a bias voltage having the same polarity as toner 30K. Charge roller 22K evenly charges the surface of photosensitive drum 21K with the bias voltage applied from the charge-roller power supply.

Development roller 23K is connected to a development-roller power supply (not shown) configured to apply a bias voltage having a polarity which is either the same as or opposite to that of toner 30K. Development roller 23K attaches charged toner 30K to the electrostatic latent image on photosensitive drum 21K using the bias voltage applied from the development-roller power supply.

Development blade 24K is connected to the development-roller power supply or to a supply-roller power supply (both not shown) configured to apply a bias voltage having a polarity which is either the same as or opposite to that of toner 30K. Development blade 24K charges toner 30K on development roller 23K using the bias voltage thus applied, and also restricts the layer thickness of toner 30K with a contact pressure.

Supply roller 25K is connected to a supply-roller power supply (not shown) configured to apply a bias voltage having a polarity which is either the same as or opposite to that of toner 30K. Using the bias voltage applied from the supply-roller power supply, supply roller 25K supplies development roller 23K with toner 30K provided from toner supply container 31K which is a developer container of toner cartridge 3K. Supply roller 25K also charges toner 30K using a frictional force generated by the contact between supply roller 25K and development roller 25K.

Cleaning blade 26K cleans the surface of photosensitive drum 21K by scraping off remaining toner 30K left on the surface of photosensitive drum 21K. Cleaning blade 26K also cleans adhered matter which is, although in minute amounts, attached from transfer belt 9 to the surface of photosensitive drum 21K.

First transport unit 27K transports waste toner 30K (e.g. toner 30K and the other adhered matter that were attached to photosensitive drum 21K and then removed by cleaning blade 26K) to a near side of photosensitive drum 21K in the rotation axial direction. Waste toner 30K transported by first transport unit 27K is transported to a discharged-matter storage (waster toner container) 32 by second transport unit 28 which is a transport unit forming a transport path for waste toner 30K by being connected to first transport unit 27K.

Second transport unit 28 collectively transports, in the Z direction, waste toners 30K, 30C, 30M, and 30Y transported from first transport units 27K, 27C, 27M, and 27Y of process units 2K, 2C, 2M, and 2Y, respectively.

Toner cartridges 3K, 3C, 3M, 3Y have supply mechanisms (not shown) in their toner containers 31K, 31C, 31M, and 31Y, respectively. The supply mechanisms are configured to provide unused portions of toners 30K, 30C, 30M, and 30Y to process units 2K, 2C, 2M, and 2Y.

Transfer rollers 4K, 4C, 4M, and 4Y of corresponding transfer units 4 are connected to transfer-roller power supplies (not shown) each configured to apply a bias voltage having a polarity opposite to that of toners 30K, 30C, 30M, or 30Y. Using the bias voltages applied by the transfer-roller power supplies, transfer rollers 4K, 4C, 4M, and 4Y transfer the toner images formed on their respective photosensitive drums 21K, 21C, 21M, and 21Y onto sheet P.

Exposure units 5K, 5C, 5M, and 5Y irradiate the surfaces of photosensitive drums 21K, 21C, 21M, and 21Y with light, based on print data inputted, and form electrostatic latent images through attenuation of potentials in the surface area thus irradiated.

Sheet P fed in the X direction into the sheet feeder inside paper feed cassette 6 is transported to image formation cartridge 20 by a transport roller (not shown).

In the fixation unit 7, the heater is controlled based on the surface temperature of heat roller 7*a* detected by the thermistor and thereby maintains the surface temperature of heat roller 7*a* to a predetermined temperature. When sheet P having the toner images transferred thereon passes through the pressure contact portion formed by pressure roller 7*b* and heat roller 7*a* maintained to have the predetermined temperature, heat and pressure is applied to the sheet P, thereby fixing the toner images on sheet P.

(A-2-2) Operations within the Image Formation Cartridge

Next, operations of image formation cartridge 20 are described.

The image formation cartridge 20 integrally has process units 2K, 2C, 2M, and 2Y, and is attachable to and detachable from printer 1 as a unit.

In color printing, photosensitive drum shafts 41K, 41C, 41M, and 41Y are located, by their own weights, at their image formation positions along the guides in printer 1, and printing operations are performed by process units 2K, 2C, 2M, and 2Y. In black-and-white printing, photosensitive drum shafts 41C, 41M, and 41Y are lifted up in the W directions by the process unit lift-up mechanism (not shown) to locate process units 2C, 2M, and 2Y at non-image-formation positions, so that printing operations may be performed using only process unit 2K located at the image formation position.

(A-2-3) Evaluation Experiment of Embodiment

Descriptions are given below of results of an evaluation experiment conducted by actually constructing printer 1 of the first embodiment and causing printer 1 to perform continuous printing. Here, printer 1 of the first embodiment is constructed by mounting image formation cartridge 20 including process unit 2K of the first embodiment onto an OKIDATA (registered trademark) printer, model number c530dn.

Then, using printer 1 of the first embodiment thus constructed, continuous printing is performed up to 40K drum counts (which is twice the life of a conventional image formation cartridge mounted on a printer of the same type) under such conditions as the use of A4 paper, a 0.3% duty, and 1P/J.

Figure 8:
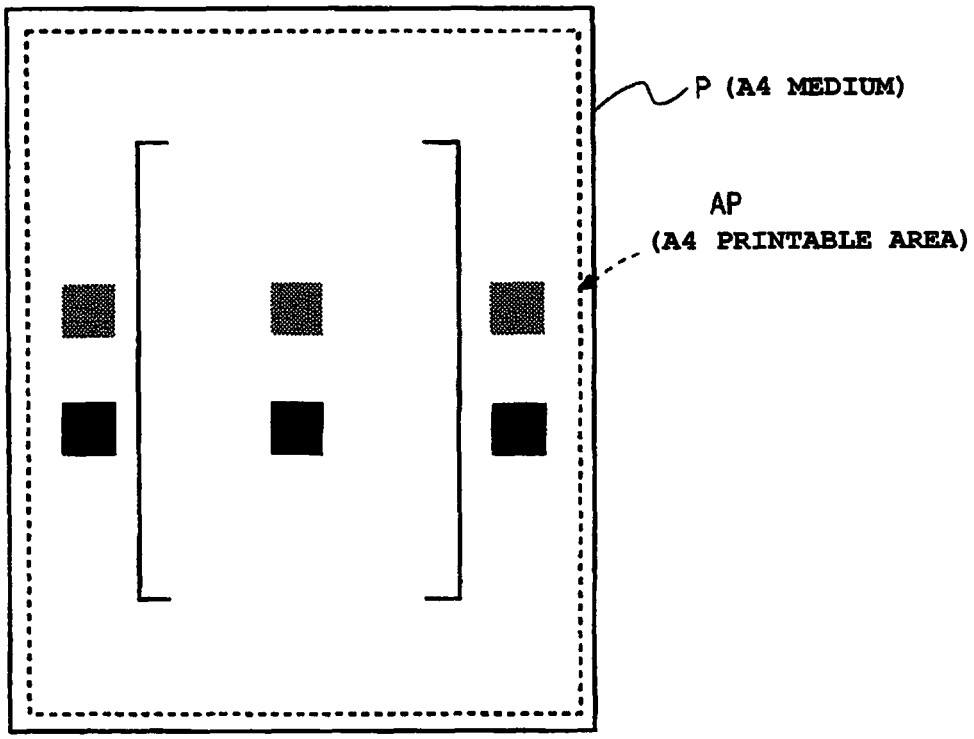
FIG. 8 is a view illustrating a print pattern used to evaluate the image formation apparatus according to the first through third embodiments.

"% duty" mentioned above is a unit indicating a percentage of a printed area to a printable area of a sheet to be printed (here, A4 paper). Accordingly, "0.3% duty" for A4 paper indicates that the printing is performed for a 0.3% area out of a printable area of A4 paper. Here, a print pattern shown in FIG. 8 is used as a print pattern satisfying the 0.3% duty. Note that the print pattern shown in FIG. 8 shows a print pattern for a single color of black (K).

In addition, "P/J" mentioned above is an abbreviation for "page/job," and is a unit indicating how many sheets are printed per job. Accordingly, "1P/J" above indicates that one sheet is printed per job.

Further, "drum count" mentioned above is a unit indicating the number of rotations of the photosensitive drums. Accordingly, "40K drum counts" above indicates that the print processing performed by rotating the photosensitive drums 40K (40000) times.

FIG. 9 shows, in a tabular form, the evaluation results of the printing performed using the printer according to the embodiment under the conditions described above. FIG. 9 also shows the evaluation results of the second and third embodiments, but only the evaluation results for the first embodiment is described now.

In the table in FIG. 9, a circle (○) for an evaluation result indicates that no toner is leaked (i.e., no toner is leaked through seal sponges 301 and 302 of cleaning blade 26K). Further, in the table in FIG. 9, a triangle (Δ) for an evaluation result indicates that toner is leaked through seal sponges 301 and 302 of cleaning blade 26K and is dropped within process unit 2K, or the like. Further, in the table in FIG. 9, a cross (x) for an evaluation result indicates that toner is leaked through seal sponges 301 and 302 of cleaning blade 26K, and is dropped to the sheet.

Figure 10:
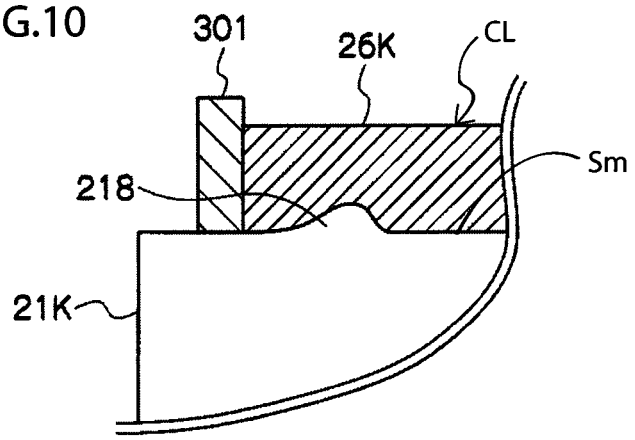
FIG. 10 is a main part enlarged sectional view of a process unit according to Comparative Example 1 with respect to the first embodiment, showing large-diameter portions being arranged on an inner side of the seal sponges.
Figure 11:
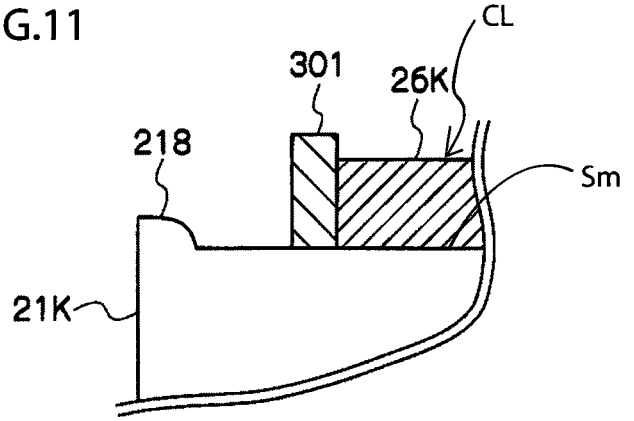
FIG. 11 is a main part enlarged sectional view of a process unit according to Comparative Example 1 with respect to the first embodiment, showing the large-diameter portions being arranged on an outer side of the seal sponges.

FIG. 9 also shows a "Comparative Example 1" and "Comparative Example 2" as targets for comparison with the first embodiment. In "Comparative Example 1," large-diameter portions 218 and 219 are formed at positions inward of areas to be in contact with seal sponges 301 and 302 (see FIG. 10). In "Comparative Example 2," large-diameter portions 218 and 219 are formed outward of the areas to be in contact with seal sponges 301 and 302 (see FIG. 11). Accordingly, the conditions in Comparative Example 2 are somewhat similar to the photosensitive drums and cleaning blades in a conventional image formation apparatus. Note that all of the other conditions for Comparative Examples 1 and 2 are the same as those for the first embodiment.

As to Comparative Example 1 in FIG. 9, an evaluation result for "continuous printing 20K" is "Δ." Accordingly, FIG. 9 shows that the evaluation result is Δ for continuous printing performed using the printer of Comparative Example 1 up to 20K drum counts under the above-described conditions. Specifically, in FIG. 9, when continuous printing of up to 40K drum counts is performed using the printer of Comparative Example 1 under the above-described conditions, the evaluation result is Δ for 20K drum counts, and is x for 25K drum counts. In other words, FIG. 9 shows that when continuous printing of up to 40K drum counts is performed using the printer of Comparative Example 1, a toner leak within the process unit starts before 20K drum counts, and the leaked toner is dropped to the sheet between 20K and 25K drum counts.

When continuous printing of up to 40K drum counts is performed using the printer of Comparative Example 2 under the same conditions, a toner leak within the process unit starts before 20K drum counts, and the leaked toner is dropped to the sheet between 20K and 25K drum counts, as shown in FIG. 9.

In contrast, as shown in FIG. 9, when continuous printing of up to 40K drum counts is performed using printer 1 of the first embodiment under the same conditions as Comparative Examples 1 and 2, a toner leak within the process unit starts between 30K and 35K drum counts, but the toner leak stays inside the process unit 2K even when the printing is continued up to 40K drum counts. In other words, results obtained by this evaluation experiment show that printer 1 of the first embodiment offers a higher effect of toner leak prevention (or can delay the occurrence of a toner leak more) than Comparative Examples 1 and 2.

(A-3) Effects of the First Embodiment

According to the first embodiment, effects as follows can be provided.

As can be seen from the evaluation results shown in FIG. 9, printer 1 of the first embodiment offers a higher toner leak prevention effect than Comparative Examples 1 and 2.

Especially, since printer 1 of the first embodiment offers a higher toner leak prevention effect than Comparative Example 1, it can be understood that the mere provision of steps (e.g., large-diameter portions 218 and 219) to the surface of photosensitive drum 21K does not greatly affect the toner leak prevention. In addition, since printer 1 of the first embodiment offers a higher toner leak prevention effect than Comparative Example 1, it is clear that the toner leak prevention effect is greatly improved by bringing seal sponges 301 and 302 into contact with the areas including rising surfaces α and β, respectively. A reason for this is that rising surfaces α and β formed at the inner-side ends of large-diameter portions 218 and 219, respectively, function as walls stopping the toner coming from the inner side, and making it difficult for the toner to leak out of the walls.

FIG. 9 also shows an evaluation item for a "manufacturing cost" for Comparative Examples 1 and 2 as well as the first embodiment. In this item for a manufacturing cost in FIG. 9, the lower the manufacturing cost, the lower the value. In the first embodiment, since seal sponges 301 and 302 have to be adjusted to be in contact with the areas including rising surfaces α and β, a higher manufacturing cost is required than in Comparative Examples 1 and 2 described above. For this reason, in FIG. 9, the manufacturing cost for each of Comparative Examples 1 and 2 is "1," whereas the manufacturing cost for the first embodiment is "2."

(B) Second Embodiment

With reference to the drawings, a second embodiment of a process unit and an image formation apparatus according to the invention is described in detail.

(B-1) Configuration of the Second Embodiment

The second embodiment is different from the first embodiment only in the configurations of photosensitive drums 21K, 21C, 21M, and 21Y; therefore, the second embodiment is described below only on points different from the first embodiment. Note that, as in the first embodiment, the configuration of only photosensitive drum 21K is described below. Having the same configurations as photosensitive drum 21K, other photosensitive drums 21C, 21M, and 21Y are not described.

Figure 12:
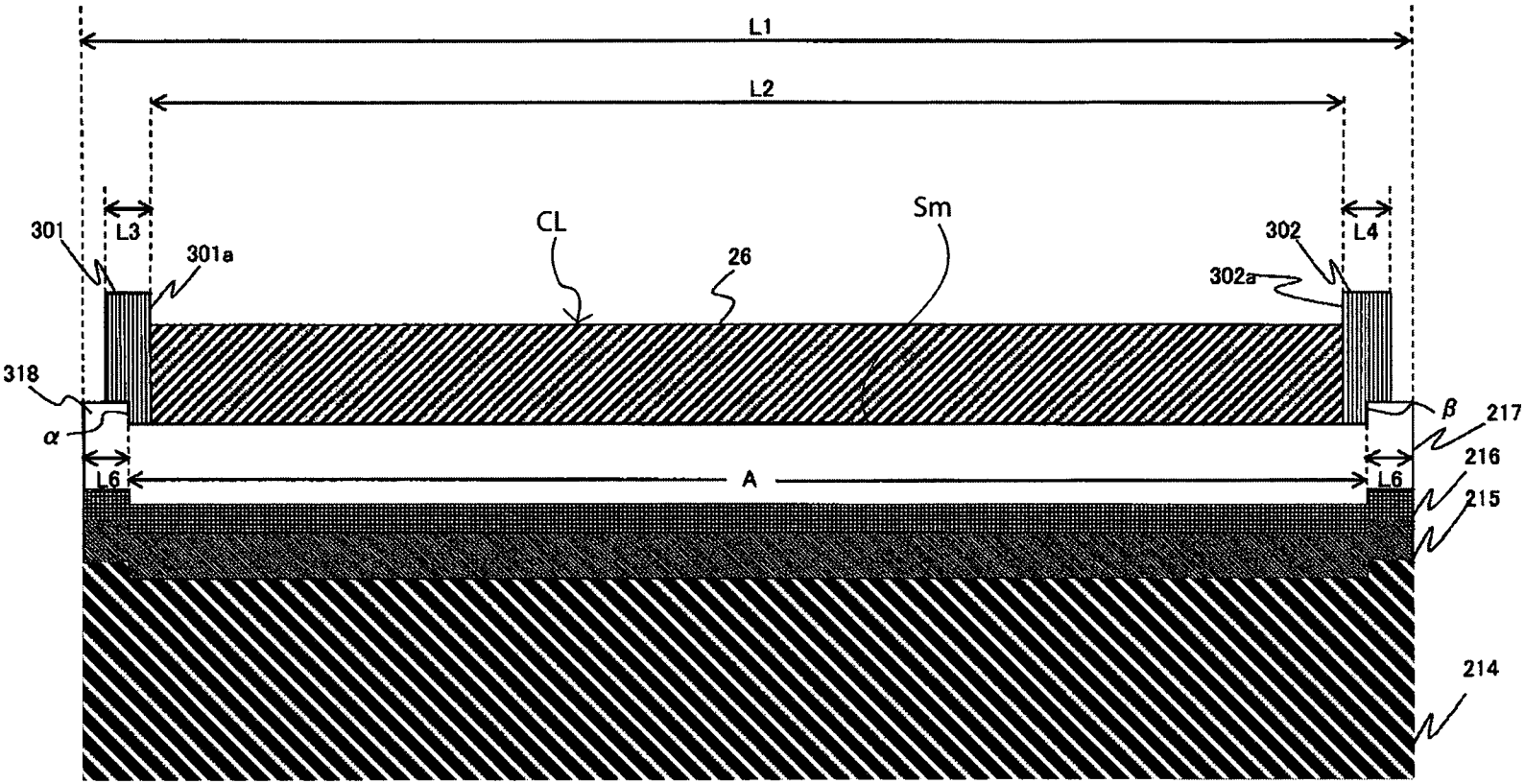
FIG. 12 is a main part enlarged sectional view showing a cleaning member pressed to a photosensitive drum according to a second embodiment.

FIG. 12 is a main part enlarged sectional view showing cleaning blade 26K (including seal sponges 301 and 302) in pressure contact with photosensitive drum 21K. Note that in FIG. 12, portions that are the same as or correspond to those of FIG. 1 described above are given reference numerals that are the same as or correspond to those of FIG. 1.

In the first embodiment, large-diameter portions 218 and 219 (rising surfaces α and β) are formed in the surface of photosensitive drum 21K by utilizing the charge-transport-layer application liquid (charge transport layer 217) accumulated at both end portions of photosensitive drum 21K (conductive support 214). In the second embodiment, however, large-diameter portions 318 and 319 (rising surfaces α and β) having configurations different from those of the first embodiment are formed through process steps different from the first embodiment.

The second embodiment is different from the first embodiment in the shape of conductive support 214 constituting photosensitive drum 21K. Specifically, in conductive support 214 constituting photosensitive drum 21K of the second embodiment, areas to be large-diameter portions 318 and 319 have different outer diameters from that of the other area (i.e., an area to be main surface Sm). To be more specific, in the first embodiment, large-diameter portions 218 and 219 are provided by thickening partially, namely the outermost portions of, charge transport layer 217 formed above the surface of conductive support 214 which has a constant outer diameter. In the second embodiment, on the other hand, the outer diameter of conductive support 214 is different between the area to be main surface Sm and the areas to be large-diameter portions 318 and 319. In the second embodiment, conductive support 214 having a constant outer diameter is first prepared, and then steps are provided to this conductive support 214 by performing cutting work on area A (the area to be main surface Sm).

Specifically, in the second embodiment, conductive support 214 itself has an outer diameter of 30 mm for area A (the area to be main surface Sm) and an outer diameter of 30.10 mm for each of areas other than area A (namely, the areas to be large-diameter portions 318 and 319). Accordingly, the areas other than area A are larger than area A in outer diameter by 0.1 mm. For example, conductive support 214 may be formed as follows. First, a cylindrical pipe having a thickness of 0.80 mm, an outer diameter of 30.10 mm, and a length of 253.45 mm is formed through cutting work. Then, the cylindrical pipe is subjected to cutting work again to reduce the peripheral surface of area A (the area to be main surface Sm) by 50 μm, so that area A (the area to be main surface Sm) may have a thickness of 0.75 mm and an outer diameter of 30 mm. In the second embodiment, conductive support 214 is formed through two process steps of cutting work as described above. However, conductive support 214 may be provided with desired steps in its surface through one process step of cutting work.

Then, as in the first embodiment, blocking layer 215, charge generation layer 216, and charge transport layer 217 are stacked on conductive support 214 thus provided with the steps in its surface as described above. Photosensitive drum 21K is thus formed. Note that since conductive support 214 is originally provided with the steps in the second embodiment, the second embodiment, unlike the first embodiment, does not require any area-by-area adjustment of differentiating the thicknesses in the process step of staking charge transport layer 217. In other words, in the second embodiment, charge transport layer 217 may have an even thickness throughout the entire area.

In this way, as in the first embodiment, large-diameter portions 318 and 319 each having an outer diameter larger than that of the other area by 50 μm are formed at both ends of main surface Sm (area A).

(B-2) Operations of the Second Embodiment

The overall operations of printer 1 of the second embodiment are similar to those of the first embodiment, and therefore are not described in detail.

An evaluation experiment is conducted also for printer 1 of the second embodiment under the same conditions as in the first embodiment. The results are explained using FIG. 9 described above. When continuous printing of up to 40K drum counts is performed using printer 1 of the second embodiment under the same conditions as in the first embodiment, as shown in FIG. 9 a toner leak within the process unit starts between 35K and 40K drum counts, but the toner leak stays inside the process unit 2K even when the printing is continued up to 40K drum counts. In other words, results obtained by this evaluation experiment show that printer 1 of the second embodiment offers a higher effect of toner leak prevention (or can delay the occurrence of a toner leak more) than the first embodiment.

(B-3) Effects of the Second Embodiment

The second embodiment can provide the effects as follows as compared with the first embodiment.

In the first embodiment, large-diameter portions 218 and 219 are formed in the surface of photosensitive drum 21K by utilizing the charge-transport-layer application liquid (charge transport layer 217) accumulated at both end portions of photosensitive drum 21K (conductive support 214). For this reason, in the first embodiment, rising surfaces α and β formed on outer sides of main surface Sm (rising surfaces α and β formed at inner sides of large-diameter portions 218 and 219) are gentle slopes, as shown in FIG. 1. In contrast, in the second embodiment, since the shapes of the steps provided in the surface of conductive support 214 are almost directly reflected in the surface (charge transport layer 217) of photosensitive drum 21K, the slopes of rising surfaces α and β are steeper than in the first embodiment. In the second embodiment, angles (edges) can be formed in upper portions of rising surfaces α and β (portions having the largest outer diameters), unlike the first embodiment. Accordingly, it is clear from the evaluation results described above that the toner leak prevention effect is improved more in the second embodiment than in the first embodiment, owing to the characteristic shapes of the large-diameter portions 318 and 319.

In the second embodiment, the angles (edges) formed at the upper portions of rising surfaces α and β improve the toner leak prevention effect as described above, but they tend to wear out seal sponges 301 and 302. In other words, the first embodiment offers an effect of seal sponges 301 and 302 being less likely to be worn out than in the second embodiment.

Further, the second embodiment requires a process step for machining conductive support 214 as described above, and therefore requires a higher manufacturing cost than the first embodiment. Accordingly, in FIG. 9 described above, an evaluation value for the manufacturing cost of the second embodiment is "3." In other words, the first embodiment requires a lower manufacturing cost than the second embodiment.

(C) Third Embodiment

With reference to the drawings, a third embodiment of a process unit and an image formation apparatus according to the invention is described in detail below. Note that the image formation apparatus of this embodiment is a printer.

(C-1) Configuration of the Third Embodiment

The third embodiment is different from the first and second embodiments only in the configuration of photosensitive drum 21K; therefore, the third embodiment is described below only on points different from the first and second embodiments. Note that, as in the first and second embodiments, the configuration of only photosensitive drum 21K is described below. Having the same configurations as photosensitive drum 21K, other photosensitive drums 21C, 21M, and 21Y are not described.

Figure 13:
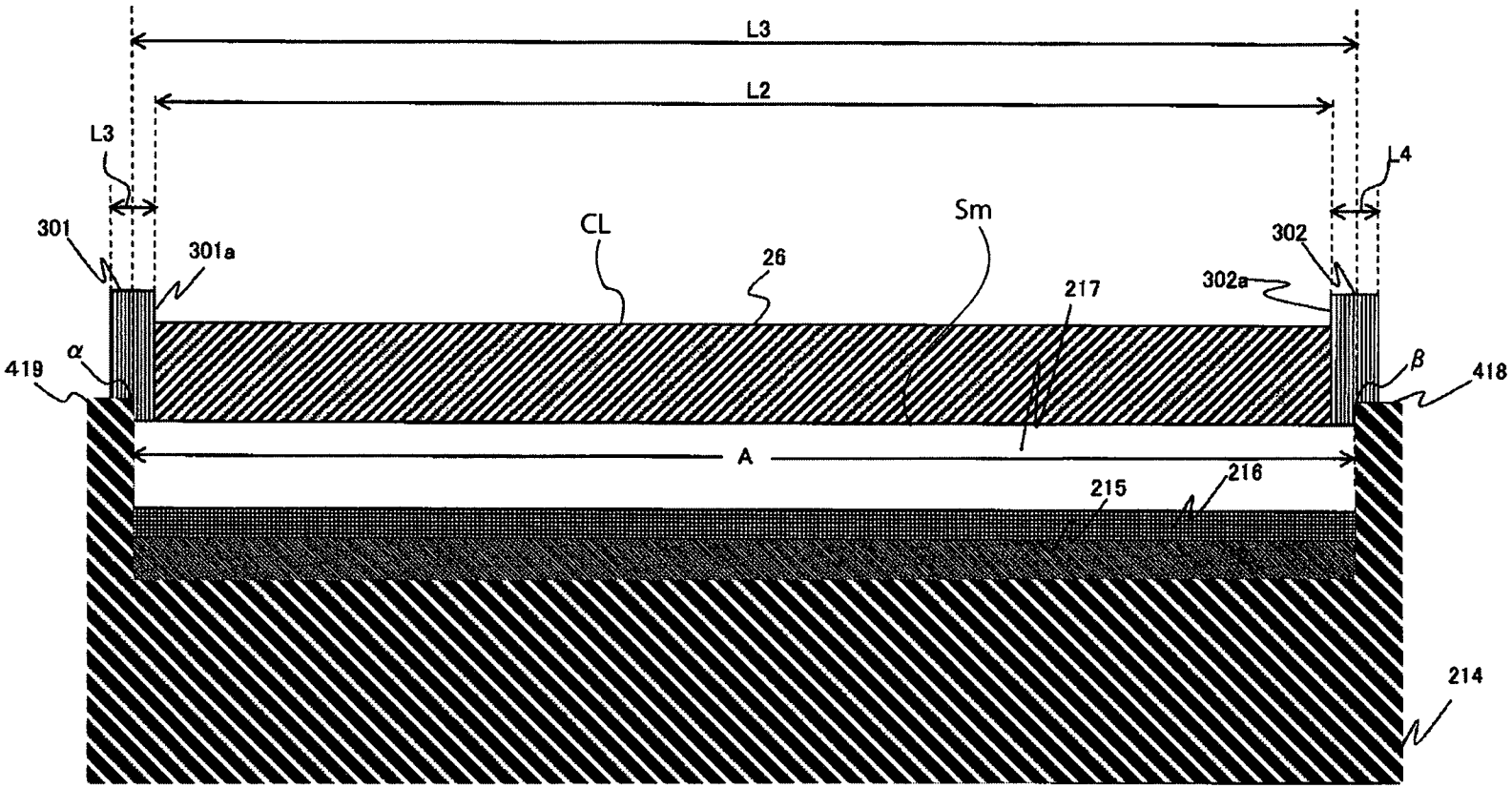
FIG. 13 is a main part enlarged sectional view showing a cleaning member pressed to a photosensitive drum according to a third embodiment.

FIG. 13 is a main part enlarged sectional view showing cleaning blade 26K (including seal sponges 301 and 302) of the third embodiment in pressure contact with photosensitive drum 21K. Note that in FIG. 13, portions that are the same as or correspond to those of FIG. 1 described above are given reference numerals that are the same as or correspond to those of FIG. 1.

In the first embodiment, large-diameter portions 218 and 219 (rising surfaces α and β) are formed in the surface of photosensitive drum 21K by utilizing the charge-transport-layer application liquid (charge transport layer 217) accumulated at both end portions of photosensitive drum 21K (conductive support 214). In the second embodiment, large-diameter portions 318 and 319 are formed by machining, and thereby forming steps in, the surface of conductive support constituting photosensitive drum 21K. In the third embodiment, the steps are formed in the surface of conductive support 214 constituting photosensitive drum 21K as in the second embodiment. However, any layer is stacked at areas to be large diameter 418 and 419 to expose conductive support 214 at those areas.

The third embodiment is different from the first and second embodiments in the shape of conductive support 214 constituting photosensitive drum 21K. Specifically, in the third embodiment, no layer is stacked on the areas to be large-diameter portions 418 and 419. Accordingly, in conductive support 214 itself, the height of each step between an area to be main surface Sm (area A) and the areas to be large-diameter portions 418 and 419 has to be larger than in the second embodiment.

In the third embodiment, conducive support 214 itself has an outer diameter of 30 mm for area A and an outer diameter of 30.14 mm for areas other than area A (the areas to be large-diameter portions 418 and 419). Accordingly, the areas other than area A are larger than area A in outer diameter by 0.14 mm. For example, the conductive support may be formed as follows. First, a cylindrical pipe having a thickness of 0.82 mm, an outer diameter of 30.14 mm, and a length of 253.45 mm is formed through cutting work. Then, the cylindrical pipe is subjected to cutting work again to reduce the peripheral surface of area A by 70 μm, so that area A may have a thickness of 0.75 mm and an outer diameter of 30 mm. In the third embodiment, conductive support 214 is formed through two process steps of cutting work as described above. However, conductive support 214 may be provided with desired steps in its surface through one process step of cutting work.

In the third embodiment, after the formation of conductive support 214, blocking layer 215, charge generation layer 216, and charge transport layer 217 are stacked only on area A through the same process steps as in the first embodiment. Thus, in photosensitive drum 21K of the third embodiment, only the area (area A) where the photosensitive layer described above is formed functions as a general photosensitive layer area. Moreover, in photosensitive drum 21K of the third embodiment, conductive support 214 is exposed at the areas of large-diameter portions 418 and 419, and rising surfaces α and β of about 50 μm are formed at borders between area A and large-diameter portions 418 and 419.

(C-2) Operations of the Third Embodiment

The overall operations of printer 1 of the third embodiment are also similar to those of the first and second embodiments, and therefore are not described in detail.

An evaluation experiment is conducted also for printer 1 of the third embodiment under the same conditions as in the first embodiment. The results are explained using FIG. 9 described above. When continuous printing of up to 40K drum counts is performed using printer 1 of the third embodiment under the same conditions as in the first and second embodiments, as shown in FIG. 9 a toner leak within the process unit starts between 35K and 40K drum counts, but the toner leak stays inside the process unit 2K even when the printing is continued up to 40K drum counts. In other words, results obtained by this evaluation experiment show that printers 1 of the third embodiment and the second embodiment offer the same degree of toner leak prevention effects.

(C-3) Effects of the Third Embodiment

The third embodiment can provide the effects as follows as compared with the second embodiment.

In the third embodiment, large-diameter portions 418 and 419 are exposed at the surface of photosensitive drum 21K. In contrast, in the second embodiment, the steps formed in the surface of conductive support 214 are covered by the layers formed on the steps. Thus, it is more difficult in the second embodiment than in the third embodiment to form large-diameter portions 318 and 319 into desired shapes. Accordingly, the third embodiment facilitates adjustment of forming the steps into desired shapes. In other words, the third embodiment offers an effect of easier adjustment of the toner leak prevention effect than the second embodiment.

Note that the third embodiment requires masking of the areas to be large-diameter portions 418 and 419 to form the layers as described above, and therefore requires a higher manufacturing cost than the second embodiment. Accordingly, in FIG. 9 described above, an evaluation value for the manufacturing cost of the third embodiment is "4." In other words, the first and second embodiments require a lower manufacturing cost than the third embodiment.

(D) Other Embodiments

The invention is not limited to the above embodiments; modified embodiments described in the following as examples are possible as well.

D-1

In the above embodiments, seal sponges 301 and 302 are attached to both ends of cleaning blade 26K. Alternatively, only one end may be provided with the seal sponge. Similarly, only one of the large-diameter portions (stepped portions) may be formed.

In addition, the large-diameter portions (stepped portions) are both formed in the same manner in the above embodiments, but may be formed in different manners. For example, one of the large-diameter portions (stepped portions) may be formed in the manner of the first embodiment, and the other one of the large-diameter portions (stepped portions) may be formed in the manner of the second embodiment.

D-2

In the second embodiment, charge transport layer 217 is stacked on large-diameter portions 318 and 319 through the same process as for the other area (area A). Alternatively, the steps may be adjusted in height by utilizing the accumulated liquid at the areas to be large-diameter portions 318 and 319, as in the first embodiment.

D-3

In the third embodiment, conductive support 214 is exposed at the areas of large-diameter potions 418 and 419. Alternatively, only part of the layers (e.g., only blocking layer 215) may be stacked.

D-4

Although printer 1 (image formation apparatus) of the invention includes four process units 2K, 2C, 2M, and 2Y in the above embodiments, the number of process units to be included is not limited.

D-5

Although the image formation apparatus of the invention is applied to a printer in the above embodiments, it can be applied to other apparatuses configured to form an image on a transfer medium (sheet) using a process unit, such as a facsimile machine or a copying machine (e.g., a copier).

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A process unit comprising:

a cylindrical image carrier having a surface which includes a main surface and a projection portion, the projection portion provided at least at one end portion of the main surface and having a rising surface rising up from the main surface such that a large-diameter portion is provided at an area corresponding to the projection portion, which has a larger diameter than an area corresponding to the main surface; and a cleaning member configured to remove developer on the surface of the image carrier and including:

a cleaning member body configured to come in contact with the main surface; and sealing members provided at least at one end of the cleaning member body and being in continuous contact with the main surface, the rising surface, and a border between the main surface and the rising surface, wherein the large-diameter portion has a convex shape such that a diameter of the large-diameter portion increases in a direction from a center position of the image carrier towards an axial end of the image carrier.

2. The process unit according to claim 1, wherein the area corresponding to the main surface has an image carrier area capable of carrying an image.

3. The process unit according to claim 2, wherein the image carrier includes a photosensitive layer that comprises the surface of the image carrier.

4. The process unit according to claim 3, wherein the photosensitive layer is thicker at the area corresponding to the projection portion than at the area corresponding to the main surface.

5. The process unit according to claim 3, wherein the photosensitive layer includes a charge generation layer and a charge transport layer.

6. The process unit according to claim 5, wherein the charge transport layer is thicker at the area corresponding to the projection portion than at the area corresponding to the main surface.

7. The process unit according to claim 3, wherein the image carrier comprises:

a support; and the photosensitive layer provided on or above a surface of the support and supported by the support directly or indirectly.

8. The process unit according to claim 7, wherein the support has a larger diameter at the area corresponding to the projection portion than at the area corresponding to the main surface.

9. The process unit according to claim 8, wherein the area corresponding to the main surface is provided with the photosensitive layer.

10. The process unit according to claim 1, wherein the image carrier is a substantial cylindrical shape having a rotational axis as its center.

11. An image formation apparatus comprising the process unit of claim 1.

12. The process unit according to claim 1, wherein the image carrier includes a cylindrical support and multi-layers disposed on the cylindrical support, wherein an outermost layer of the multi-layers that is furthest apart from the cylindrical support is thicker at the area corresponding to the projection portions than at the area corresponding to the main surface, thereby forming the large diameter portions at at least one end of the image carrier.

13. The process unit according to claim 12, wherein the multi-layers include:

a charge transport layer; and a charge generation layer, wherein the outermost layer corresponds to the charge transport layer and is provided on the charge generation layer.

14. A process unit comprising:

an image carrier having a surface which includes a main surface and a projection portion, the projection portion provided at least at one end portion of the main surface and having a rising surface rising up from the main surface; and a cleaning member configured to remove developer on the surface of the image carrier and being in contact with the main surface, the rising surface, and a border between the main surface and the rising surface, wherein the image carrier comprises:

a support; and a photosensitive layer provided on or above a surface of the support and supported by the support directly or indirectly, wherein the support has a larger diameter at an area corresponding to the projection portion than at an area corresponding to the main surface, and wherein the photosensitive layer is provided to an area corresponding to the main surface and not to an area corresponding to the projection portion.

* * * * *